US011926973B2

(12) United States Patent
Koenen et al.

(10) Patent No.: US 11,926,973 B2
(45) Date of Patent: Mar. 12, 2024

(54) MOLDBOARD WITH A SCRAPING TOOL FOR A MILLING MACHINE

(71) Applicant: Caterpillar Paving Products Inc., Brooklyn Park, MN (US)

(72) Inventors: Paul Joseph Koenen, Andover, MN (US); Robert Edwin Carr, Sebastian, FL (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 17/516,088

(22) Filed: Nov. 1, 2021

(65) Prior Publication Data

US 2023/0138318 A1 May 4, 2023

(51) Int. Cl.

| | |
|---|---|
| ***E01C 23/088*** | (2006.01) |
| ***E01C 23/12*** | (2006.01) |
| *E02F 3/815* | (2006.01) |
| *E02F 9/28* | (2006.01) |

(52) U.S. Cl.

CPC ..... *E01C 23/088* (2013.01); *E01C 23/127* (2013.01); *E02F 3/8152* (2013.01); *E02F 9/2808* (2013.01)

(58) Field of Classification Search

CPC .... E01C 23/088; E01C 23/127; E02F 3/8125; E02F 9/28; E02F 9/2808; E02F 9/2816; E02F 9/2825; E02F 9/2858; E02F 9/2883; E02F 3/8152

See application file for complete search history.

(56) References Cited

U.S. PATENT DOCUMENTS

| | | | | |
|---|---|---|---|---|
| 3,152,411 | A * | 10/1964 | Wood | E02F 3/8152 172/701.3 |
| 3,465,833 | A | 9/1969 | Lutz | |
| 3,766,672 | A | 10/1973 | Hanson et al. | |
| 4,753,299 | A * | 6/1988 | Meyers | E02F 3/8152 172/701.3 |
| 4,784,517 | A * | 11/1988 | Bergqvist | E01H 5/12 404/90 |
| 4,883,129 | A * | 11/1989 | Lonn | E21C 35/183 172/701.3 |
| 5,474,397 | A * | 12/1995 | Lyons | E01C 23/088 299/39.5 |
| 5,505,598 | A * | 4/1996 | Murray | B28D 1/18 404/90 |
| 6,213,559 | B1 * | 4/2001 | Stevens | E02F 3/8152 404/90 |
| 6,799,388 | B2 * | 10/2004 | Weaver | E02F 3/8157 37/448 |
| 8,556,536 | B2 | 10/2013 | Giles | |
| 8,714,871 | B2 | 5/2014 | Giles | |

(Continued)

FOREIGN PATENT DOCUMENTS

| | | |
|---|---|---|
| CN | 207646576 U | 7/2018 |
| DE | 2707006 A1 | 8/1978 |

(Continued)

*Primary Examiner* — Janine M Kreck
*Assistant Examiner* — Michael A Goodwin
(74) *Attorney, Agent, or Firm* — Kurt Fugman

(57) ABSTRACT

A scraper for use with a moldboard of a milling machine is manufactured from a rigid material including at least one of the following: a hardened steel having a hardness of at least 50 Rockwell Scale C, a carbide, and PCD diamonds.

18 Claims, 6 Drawing Sheets

(56) References Cited

U.S. PATENT DOCUMENTS

| | | | | |
|---|---|---|---|---|
| 10,612,196 | B2 | 4/2020 | Johnson et al. | |
| 11,008,716 | B2 | 5/2021 | Berning et al. | |
| 2004/0075330 | A1* | 4/2004 | Holl | E02F 3/815 299/39.2 |
| 2008/0075534 | A1* | 3/2008 | L. Stern | E02D 3/026 404/121 |
| 2008/0129103 | A1* | 6/2008 | Hall | E01C 23/088 299/39.2 |
| 2014/0093315 | A1* | 4/2014 | Sansone | E01C 23/065 404/91 |
| 2014/0361599 | A1* | 12/2014 | Losen | E01C 23/127 299/39.2 |
| 2019/0055701 | A1* | 2/2019 | Barimani | E01C 23/121 |
| 2019/0186087 | A1* | 6/2019 | Johnson | E01C 23/088 |
| 2022/0018076 | A1* | 1/2022 | Michel | E01H 5/066 |

FOREIGN PATENT DOCUMENTS

| | | | | |
|---|---|---|---|---|
| DE | 69511765 | T2 | 4/2000 | |
| DE | 202008016935 | U1 | 6/2010 | |
| DE | 102017116757 | | 1/2019 | |
| DE | 102012012607 | B4 | 11/2020 | |
| WO | WO-2016138586 | A1 * | 9/2016 | E02F 3/8152 |

* cited by examiner

MOLDBOARD WITH A SCRAPING TOOL FOR A MILLING MACHINE

TECHNICAL FIELD

The present disclosure relates to milling machines, e.g. a cold planer, asphalt milling machine, and the like. Specifically, the present disclosure relates to a moldboard and associated attachments disposed behind the rotary cutting drum assembly of such machines.

BACKGROUND

Rotary tools such as cutting drums are routinely employed by milling machines such as cold planers, asphalt milling machines, and the like for ripping up a work surface such as soil, loose rock, asphalt, pavement, concrete, etc. During this process, a rough surface such as shown in FIG. 1 with grooves is often created. This rough surface may be problematic for several reasons.

For example, the rough surface may still be used as an interim road surface so that entire roads are not shutdown during construction. The rough surface may adversely affect traction or create undesirable vibration for vehicles that pass over the rough surface.

German Patent No. DE202008016935U1 discloses a construction machine, in particular a stabilizer or a recycler, which has a rotor housing in which a milling or mixing rotor is arranged. These machines are known for the stabilization or consolidation of soils, with which binders, or example lime or cement, can be mixed into the soil to improve its ability to be installed and as well as its load-bearing capacity. To adapt the rotor housing to different working depths of the milling and mixing rotor, the rear housing part in the direction of travel has a flap which attached to the rotor housing so that it can pivot about a horizontal axis. In order to deposit the homogeneously milled material evenly behind the stabilizer or recycler, a wiper lip is attached to the adjustable flap, which extends between the side walls of the rotor housing over the entire working width of the machine.

As can be seen, a device for removing the rough surface created by a milling machine or the like is still needed.

SUMMARY

A milling assembly for use by a milling machine is provided. Such a milling assembly according to an embodiment of the present disclosure may comprise a pair of side panels, a rear moldboard terminating at a bottom edge, and a scraper that is attached to the bottom edge of the moldboard.

A scraper for use with a moldboard of a milling machine according to an embodiment of the present disclosure may comprise a rigid material including at least one of the following: a hardened steel having a hardness of at least 50 Rockwell Scale C, a carbide, and PCD diamonds.

A scraper for use with a moldboard of a milling machine according to another embodiment of the present disclosure may comprise a rigid scraping portion manufactured from a rigid material including at least one of the following: a hardened steel having a hardness of at least 50 Rockwell Scale C, a carbide, and PCD diamonds.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
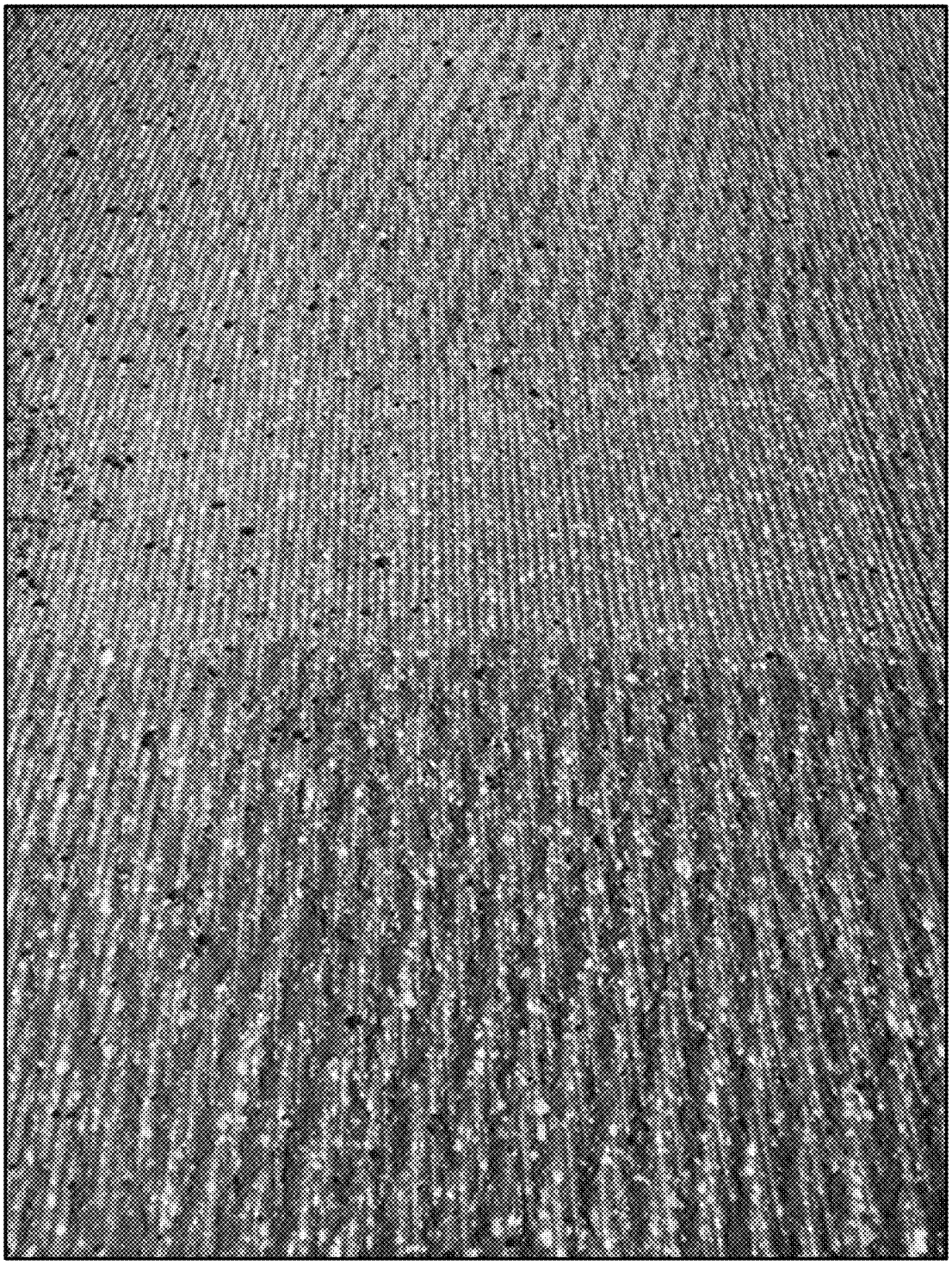
FIG. 1 PRIOR ART
FIG. 1 illustrates a rough cut asphalt surface that may be created by a milling machine if a device such as a scraper configured according to an embodiment of the present disclosure is not used.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

The present disclosure relates to the moldboard of a milling asphalt machine. Currently, moldboards do not fully remove the material from breakout areas left behind the milling asphalt due to bolt-on carbide scrapers. More particularly, the present disclosure pertains to a moldboard attachment in a milling asphalt machine for interacting with the surface. The machine includes attachments such as plate(s) or milling bits that act as scrapers. These scrapers may have patterns designed to interact with the breakout areas and can be attached to the moldboard.

Figure 2:
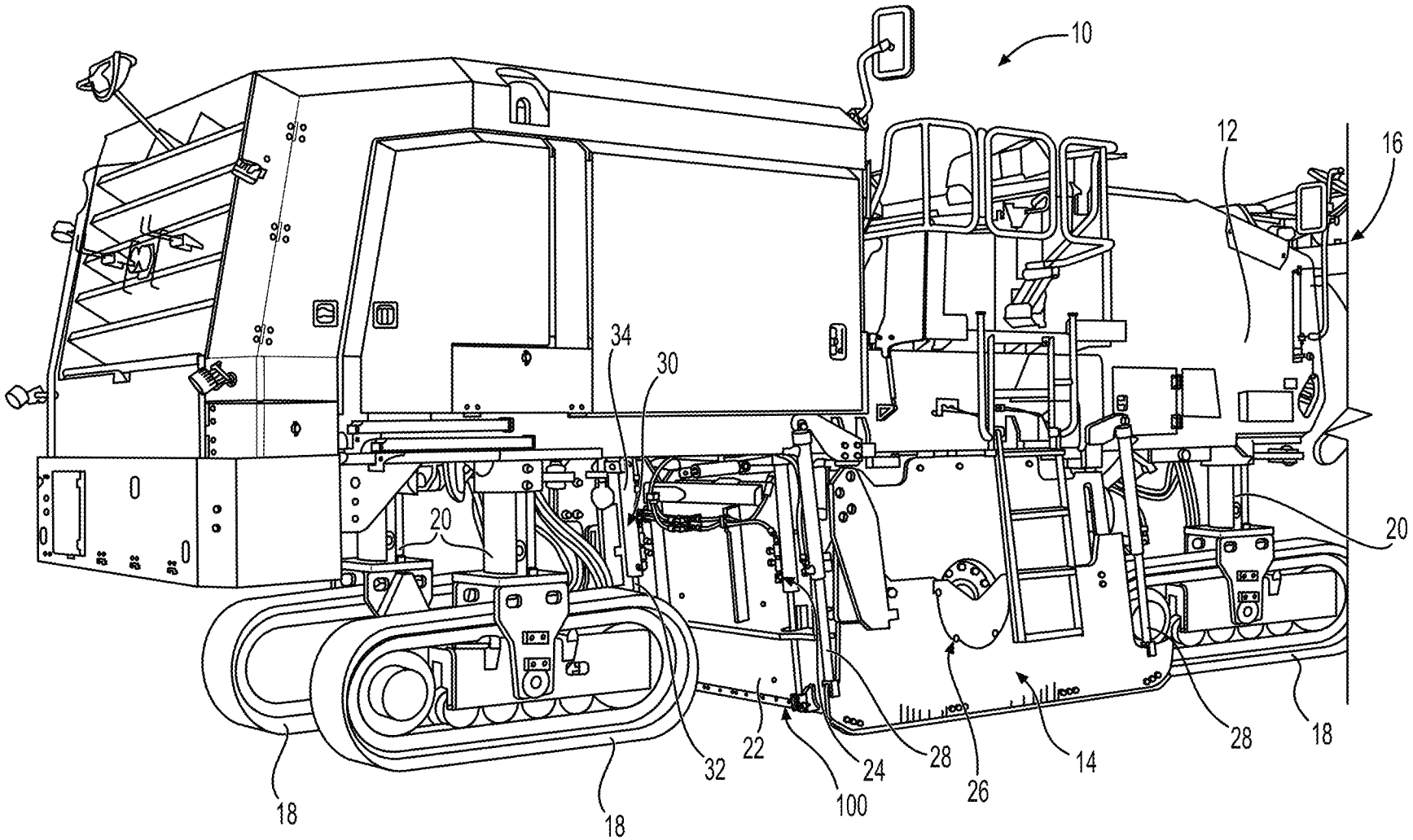
FIG. 2 is a perspective view of a machine such as an asphalt milling machine or the like that includes a milling assembly with a moldboard at its rear. This machine employs a scraper attached to the moldboard according to an embodiment of the present disclosure.

FIG. 2 illustrates a perspective view of an exemplary milling machine 10, according to the present disclosure. Machine 10 includes a frame 12 and a milling assembly 14 positioned on the underside of frame 12. Milling assembly 14 may be integrally formed with frame 12 or may be otherwise coupled to frame 12. Machine 10 also includes a conveyor assembly 16 configured to advance the milled material from milling assembly 14 away from the ground surface, for example, to be deposited into a bed of a truck. Machine 10 includes a plurality of wheels or track members 18 coupled to frame 12 via a plurality of hydraulic cylinders 20. Machine 10 also includes a moldboard 22 positioned to the rear of milling assembly 14 via a moldboard support structure 24.

It is noted that milling assembly 14 may include side doors 26 on each side portion of milling assembly 14. Moldboard 22 and side doors 26 enclose an interior rotor or milling drum assembly 90 (e.g., see FIG. 5) that engages and mills the ground surface. Each side door 26 may be movably coupled to frame 12 via at least one side hydraulic cylinder 28, for example, in order to raise the side door 26 to inspect or repair milling assembly 14 and/or the internal drum assembly.

Referring to FIGS. 2 thru 5, the moldboard 22 may help milling assembly 14 to remove the ground surface by removing any loose aggregate or debris that has not been captured by the milling drum assembly. Moldboard 22 may help to push the loose aggregate back toward the milling drum assembly, which may then urge the aggregate to conveyor assembly 16. Removing the loose aggregate may help yield a clean and smooth milled surface behind machine 10, which may then be more easily resurfaced. In order to further urge any loose aggregate toward the milling drum assembly, moldboard 22 may also include an angled interior surface and/or nozzles to dispense fluid. As discussed in greater detail below, moldboard support structure 24 connecting moldboard 22 to machine 10 may help increase the range and degrees of freedom of motion of moldboard 22 to accurately traverse the ground surface, without introducing bending or other strains on moldboard support structure 24.

Also a scraper 100 (shown in FIGS. 2 thru 6), 200 (shown in FIGS. 7 and 8) may be attached to the moldboard in order to smooth out a surface such as asphalt, etc.

Figure 3:
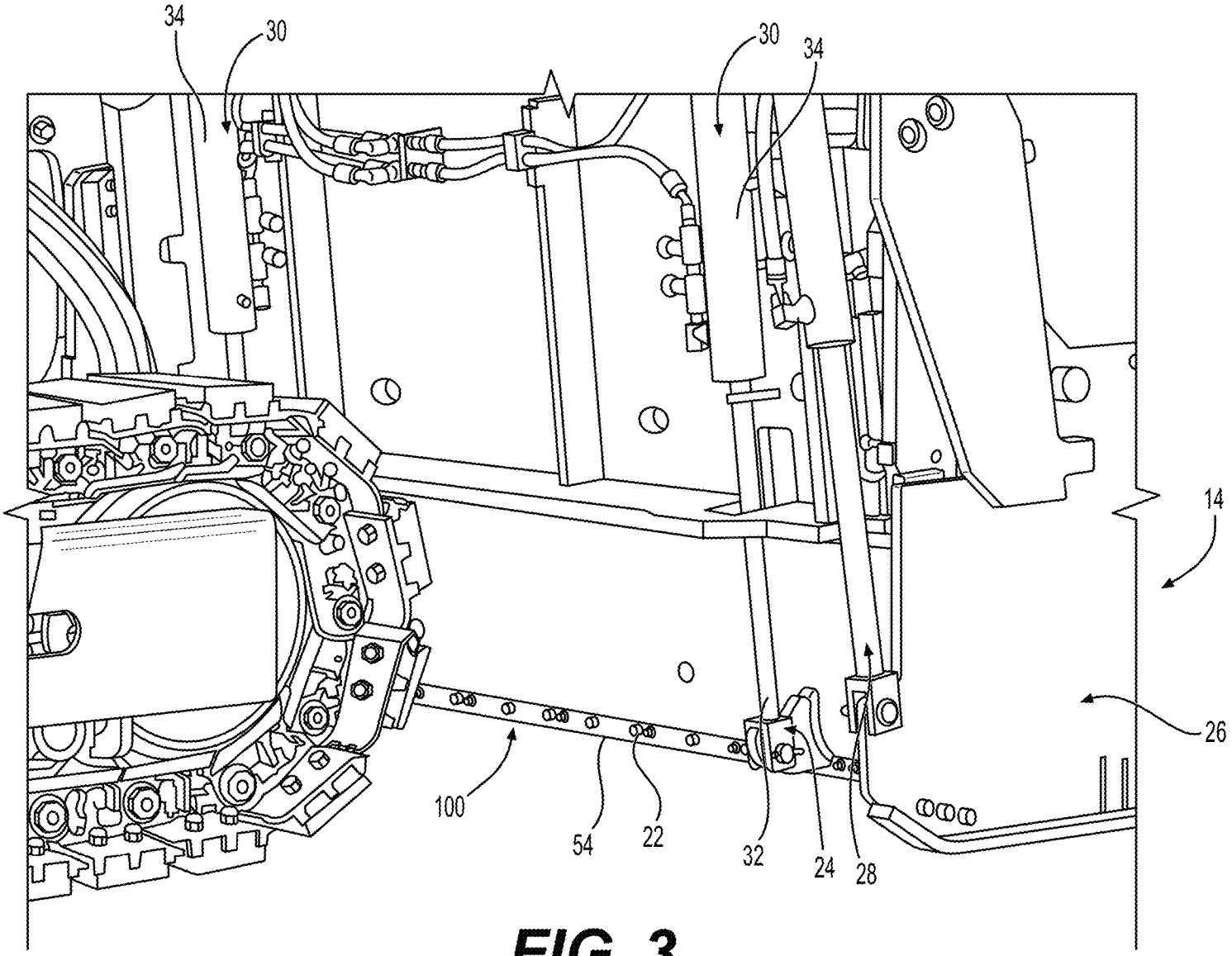
FIG. 3 is an enlarged detail view of the scraper attached to the moldboard of FIG. 2 at the rear of milling assembly.
Figure 4:
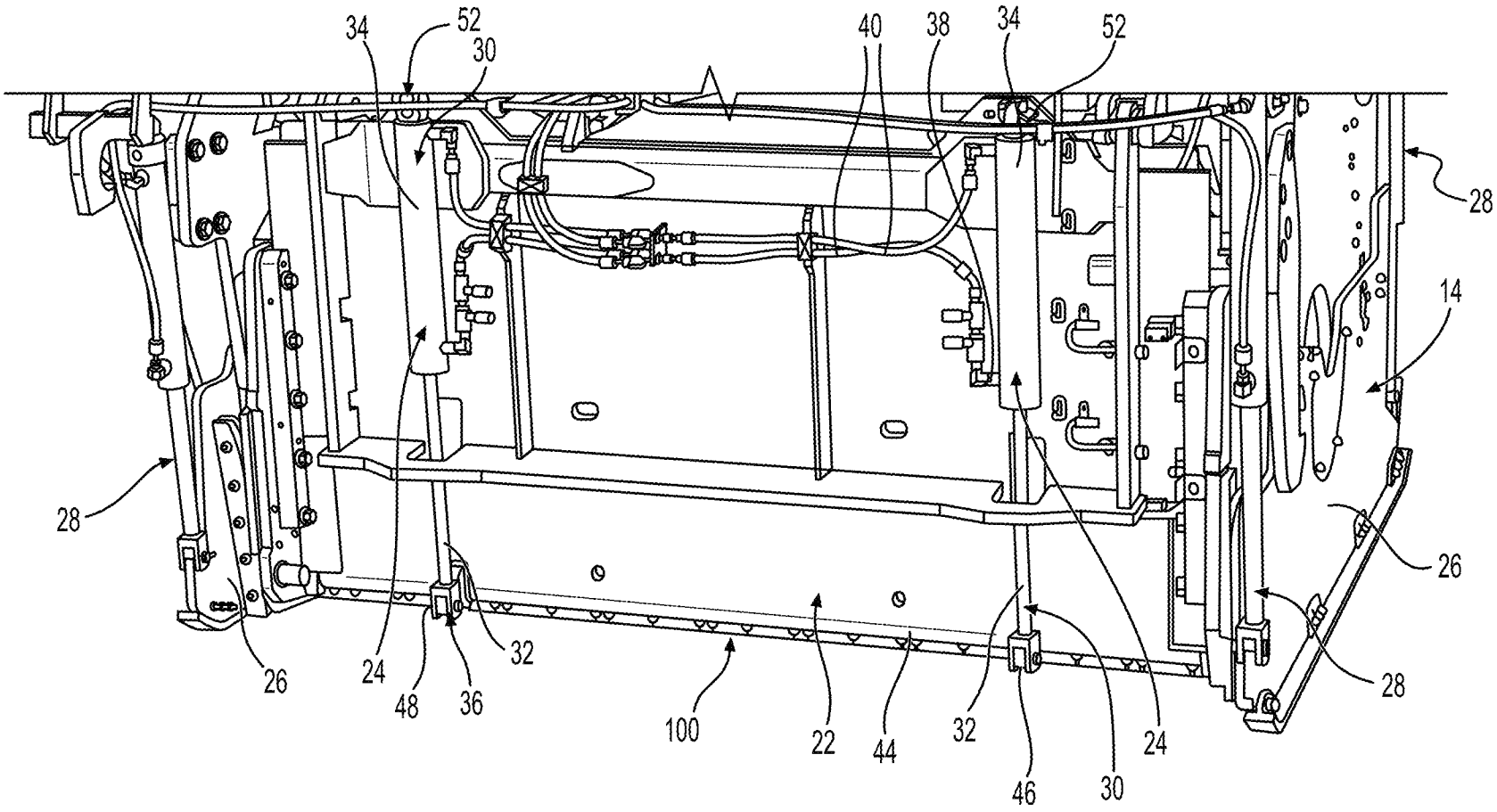
FIG. 4 is rear perspective view of the milling assembly, and moldboard employed on the milling machine of FIG. 2 removed from the machine. This views shows a scraper configured according to an embodiment of the present disclosure attached to the moldboard.

With continued reference to FIGS. 2 thru 4, the moldboard 22 is mounted to a rear portion of machine 10 via moldboard support structure 24. Moldboard support structure 24 includes a rear hydraulic cylinder 30. Rear hydraulic cylinder 30 includes a piston rod 32 movable within and extending out of a piston barrel 34. The movement and position of piston rod 32 relative to piston barrel 34 depends on the movement and pressure of hydraulic fluid, as is known to one having skill in the art.

Focusing on FIG. 4, the moldboard support structure 24 also includes a trunnion mount 52, and trunnion mount 52 may be coupled to piston barrel 34 in order to couple rear hydraulic cylinder 30 to milling assembly 14 or to frame 12. Trunnion mount 52 may allow rear hydraulic cylinder 30 to pivot in one or more directions. In one aspect, the connection of rear hydraulic cylinder 30 to machine 10 may include at least one U-joint trunnion mount, for example, a dual trunnion mount including two U-joint trunnion mounts. Moldboard support structure 24 may also include a bearing 36 coupling moldboard 22 to piston rod 32. For example, rear hydraulic cylinder 30 may be connected to a bottom portion of moldboard 22 via bearing 36. In one aspect, bearing 36 may include a spherical portion (not shown), allowing rear hydraulic cylinder 30 to pivot in at least one direction relative to the bottom portion of moldboard 22.

Figure 5:
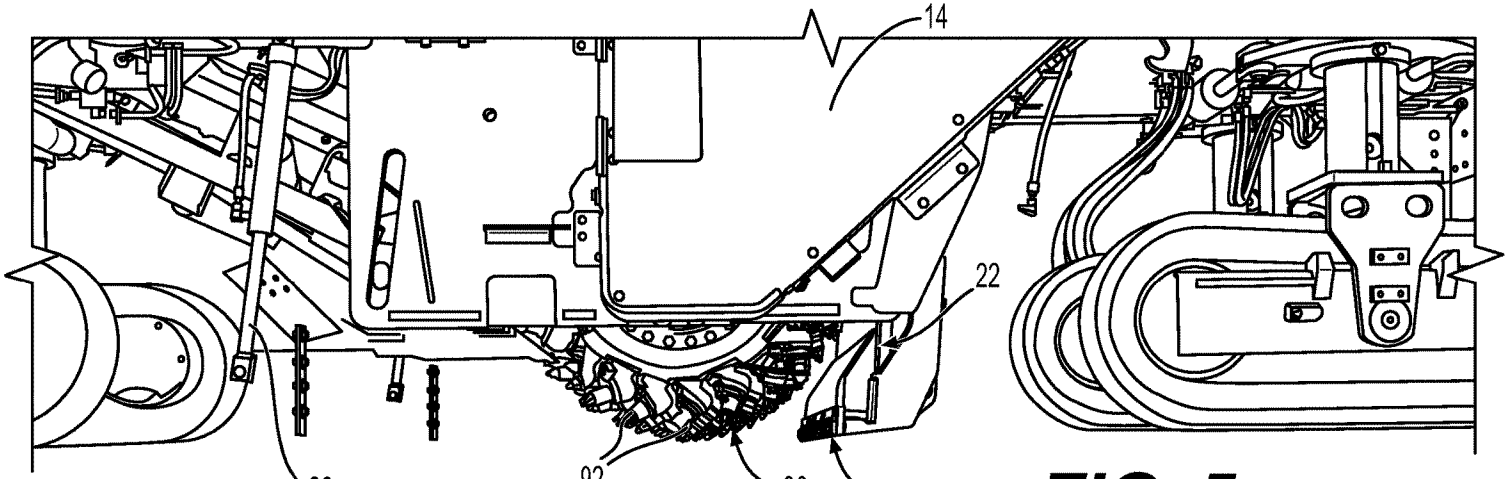
FIG. 5 is a side view of the milling machine of FIG. 2 depicting the scraper disposed behind the milling drum assembly.
Figure 6:
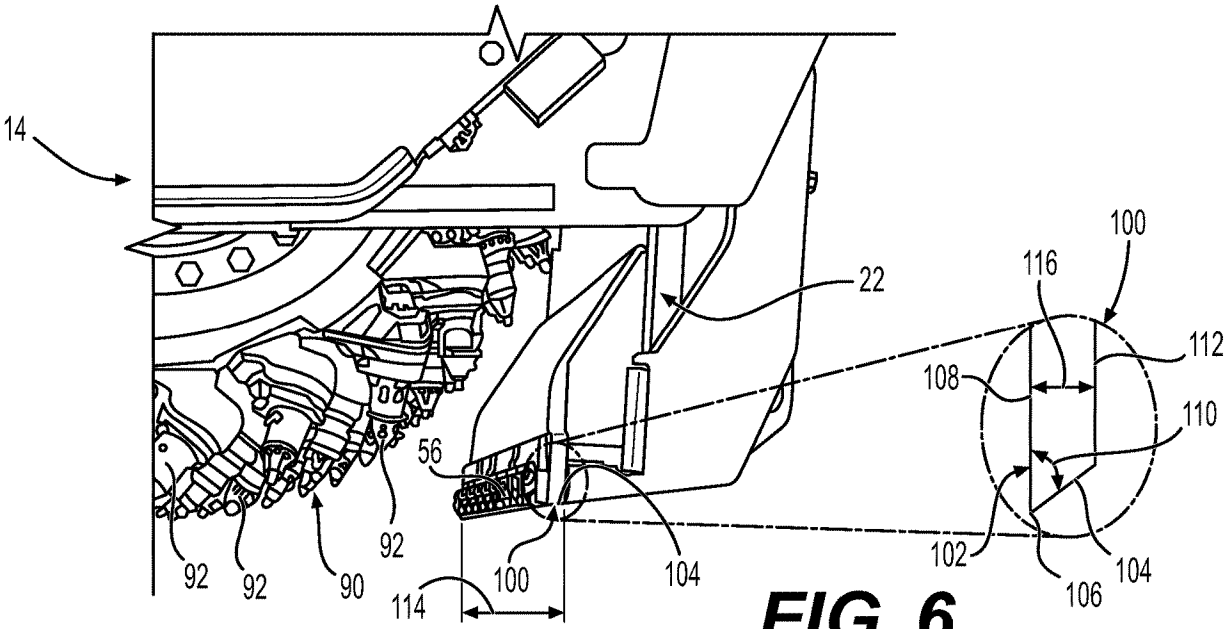
FIG. 6 is an enlarged detail view of the scraper and milling drum of FIG. 5.

FIGS. 5 and 6 show a rotary drum assembly (may also be referred to as a milling drum assembly 90) that may be provided inside of the milling assembly 14. A plurality of bits 92 are shown that break-up surfaces such as asphalt, concrete, etc. Other configurations for the milling assembly 14 are possible in other embodiments of the present disclosure.

As alluded to earlier herein, FIG. 1 shows the ruts or roughened surface of asphalt that are produced by the milling process, and that may be removed or minimized using scrapers configured according to various embodiments of the present disclosure.

FIG. 4 shows moldboard support structure 24 connecting moldboard 22 to machine 10. It is noted that portions of machine 10 are removed in FIG. 4 in order to more clearly illustrate these connections and other pertinent aspects of this disclosure. Rear hydraulic cylinder 30 includes at least two fluid ports 38 coupled to at least two hydraulic fluid lines 40 in order to selectively raise or lower piston rod 32, and accordingly raise or lower moldboard 22.

It may be necessary to raise or lower moldboard 22 in order to ensure that moldboard 22 follows the ground surface during milling and urges any loose aggregate back toward milling assembly 14 and the milling drum assembly for removal. Also, enough force may be needed to force the scraper downward to remove the striations in the asphalt, etc. Moldboard 22 may include a handle (not shown) to allow a user to grip and/or manipulate moldboard 22, for example, during inspection or repairs. It is also noted that FIG. 4 illustrates side door 26 being movably coupled to frame 12 via two side hydraulic cylinders 28 positioned, for example, at a front portion and a rear portion of side door 26.

As discussed above, rear hydraulic cylinder 30 may be coupled to moldboard 22 via bearing 36, and bearing 36 may be a cylindrical rod. Bearing 36 may allow relative movement between moldboard 22 and rear hydraulic cylinder 30, and may reduce the likelihood of wear on both components. Bearing 36 may couple a bottom portion 44 of moldboard 22 to a piston coupling 46 at a bottom of piston rod 32. Bottom portion 44 of moldboard 22 may include one or more projections 48. Piston coupling 46 and one or more projections 48 may be circular. Piston coupling 46 may be positioned adjacent to one projection 48 or between two projections 48. Bearing 36 may then pass through piston coupling 46 and the one or more projections 48. The coupling may provide for a gap on one or both sides of piston coupling 46 of rear hydraulic cylinder 30.

As noted above, rear hydraulic cylinder 30 may be coupled to machine 10 via a trunnion mount 52. Rear hydraulic cylinder 30 may be "mid-mounted" to machine 10, meaning that rear hydraulic cylinder 30 is coupled to a middle or central portion along the height of machine 10, or two such cylinders may be provided on either lateral side as shown in FIG. 4. Piston barrel 34 may be mounted on or positioned substantially even with a top portion of milling assembly 14, and below a user operation position. Trunnion mount 52 may be bolted to a top portion of milling assembly 14 or directly to frame 12. Trunnion mount 52 may be a dual-trunnion mount or double U-joint trunnion mount.

Figure 7:
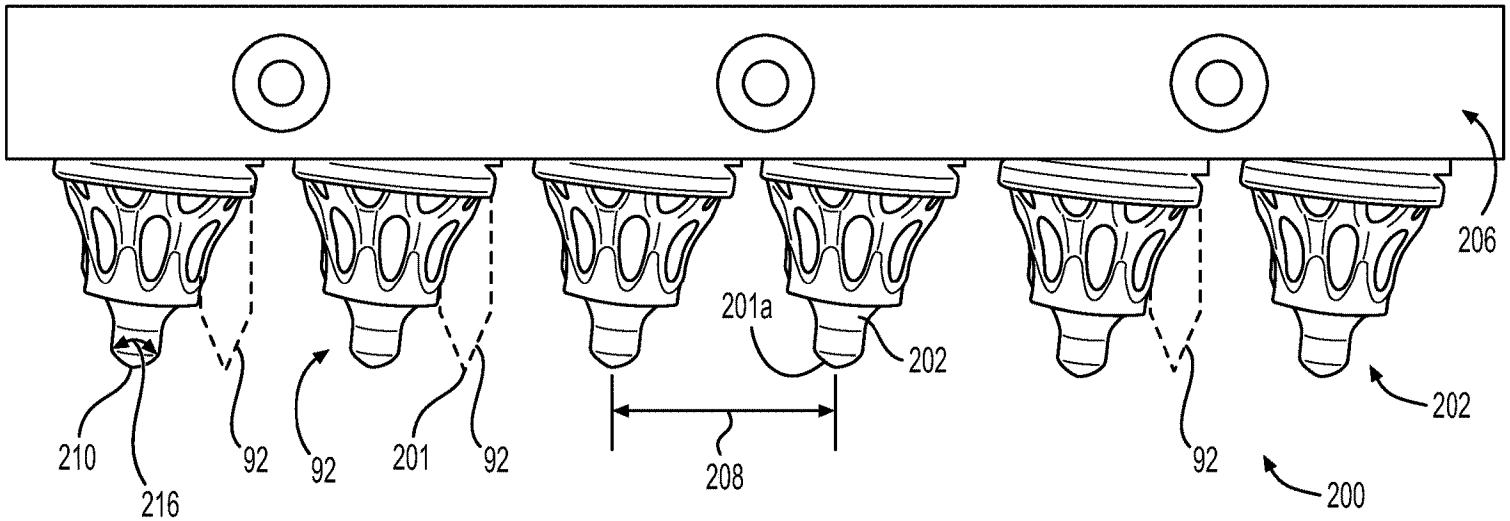
FIG. 7 is a rear view of another embodiment of scraper that employs a plurality of bits that are attached to the moldboard using a mounting plate.
Figure 8:
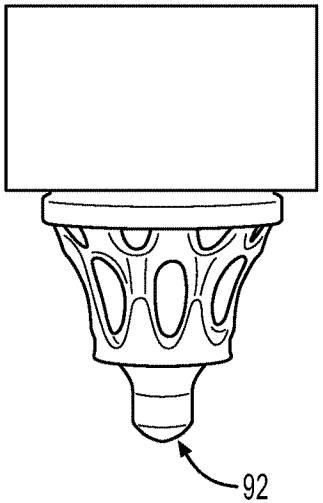
FIG. 8 shows a similar embodiment to that of FIG. 7 except that a mounting block is employed instead of a mounting plate.

Turning to FIG. 3, the scraper 100 (scraper 200 is not shown in FIG. 4 but it is to be understood that it may be substituted for scraper 100) may be fastened to the bottom edge 54 of the moldboard 22 via mounting blocks 56 shown in FIG. 6. Other methods of attachment may be used in other embodiments of the present disclosure. In FIG. 6, the scraper 100 is shown to include a rectangular side profile 102 including a bottom surface 104 that is substantially parallel to the pattern left by the cut (e.g., within 30.0 degrees). This may not be the case in other embodiments of the present disclosure. As shown in FIG. 7, the scraper 200 may include a series of projections 202 that are laterally spaced apart from each other. One or more scrapers 100, 200 may be positioned to the rear of the milling drum assembly 90, etc.

Next, one or more embodiments of a scraper that may be provided as a replacement part or a retrofit in the field will now be discussed.

Starting with FIGS. 4 and 5, such a scraper 100 for use with a moldboard of a milling machine may be made from a rigid material including at least one of the following: a hardened steel having a hardness of at least 50 Rockwell Scale C, a carbide, and PCD (polycrystalline diamond) diamonds. This rigid material may include any combination of these materials, such as an alloy, etc.

As best seen in FIG. 6, the scraper 100 may include a pointed front attack edge 106. The pointed front attack edge 106 may be formed by a front surface 108, and a bottom surface 104 that form an acute included angle 110 that ranges from 60.0 degrees to 90.0 degrees in some embodiments of the present disclosure. Other angles for the included angle may range from 0 to 180.0 degrees. In other embodiments, this pointed front attack edge may be formed by a conical surface 201*a* or the point 201 of a cutting bit 92 (e.g., see FIG. 7), etc.

Still referring to FIG. 6, a rear attachment surface 112 may connect the front surface 108 to the bottom surface 104, either directly or indirectly. Also, the pointed front attack edge 106 may be formed by a pair of surfaces (e.g., see 104, 108) comprising the rigid material.

Focusing now on FIG. 6, a scraper for use with a moldboard of a milling machine may have a rigid scraping portion manufactured from a rigid material (e.g., described above herein) that defines a width 114 (measured along the lateral direction that may be parallel to the axis of rotation of the cutting drum) to the thickness 116 (measured perpendicularly to the lateral direction) ratio.

As best seen in FIG. 7, the mount portion 206 may include a series of projections 202 that are spaced apart from each other a predetermined distance 208. More specifically, each of the series of projections may include a pointed attack edge 210. For example, the pointed attack edge may be formed by a conical surface 201*a*. This surface may define an included cone angle 216 that may range from 100.0 degrees to 160.0 degrees in some embodiments.

In some embodiments, the cutting bits 92 of the rotary cutting drum assembly may be interposed between the plurality of scrapers 200. Put another way, the scrapers 200 are spaced longitudinally (e.g., see 208) along axis 94 (may be the same as the axis or rotation of the cutting drum assembly, or nearly so). Thus, in various embodiments, the series of projections may form a pattern configured to remove the striations left during a milling process.

The arrangement, function, and dimensions of the various features of any embodiment of a scraper, milling assembly, machine, milling drum assembly, bits, etc. as discussed herein may be altered as needed or desired to be different than what has been specifically mentioned herein.

INDUSTRIAL APPLICABILITY

In practice, a scraper, a milling assembly, a moldboard, and a machine using any of these components assemblies according to any embodiment described herein may be sold, bought, manufactured or otherwise obtained in an OEM (original equipment manufacturer) or after-market context.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A milling assembly for use by a milling machine, the milling assembly comprising:

a pair of side panels;

a rear moldboard terminating at a bottom edge extending in a lateral direction; and a first scraper that is attached to the bottom edge of the moldboard that includes a plurality of projections, extending in a primarily downward direction that are spaced apart from each other in the lateral direction, wherein each of the projections extends along an axis parallel to an axis of an adjacent projection and extends at an acute angle with respect to the lateral direction.

2. The milling assembly of claim 1, further comprising a rear hydraulic cylinder with a piston rod movable within and extending out of a piston barrel.

3. The milling assembly of claim 2, further comprising at least a first trunnion mount that couples the rear hydraulic cylinder to the to the milling assembly.

4. The milling assembly of claim 3, further comprising a bearing coupling the moldboard to the piston rod.

5. The milling assembly of claim 1, wherein the first scraper is fastened to the bottom edge of the moldboard, and comprises at least one of the following materials: a metal, a plastic, or a carbide.

6. The milling assembly of claim 1, further comprising a rotary cutting drum assembly disposed forward of the first scraper, the rotary cutting drum assembly including a plurality of cutting bits, wherein the plurality of projections of the first scraper are spaced between the plurality of cutting bits in the lateral direction.

7. The milling assembly of claim 6, wherein the lateral direction extends parallel to an axis of rotation of the rotary cutting drum assembly.

8. The milling assembly of claim 1, wherein the milling machine is moveable in a direction of travel and the plurality of projections are arranged in a vertical plane normal to the direction of travel.

9. The milling assembly of claim 1, wherein each of the plurality of projections have a secured end and a free end such that a vertical line intersects the secured end and the free end.

10. The milling assembly of claim 1, wherein the acute angle is greater than 60 degrees and less than 90 degrees.

11. The milling assembly of claim 1, further comprising a moldboard support structure for raising and lowering the moldboard.

12. The milling assembly of claim 1, wherein the moldboard includes an angled interior surface.

13. A scraper for use with a moldboard of a milling machine that leaves a plurality of striations during a milling process, the scraper comprising:

a mounting portion extending along a lateral axis and configured to attach to the moldboard; and a rigid scraping portion extending along the lateral axis and manufactured from a rigid material including at least one of the following: a hardened steel having a hardness of at least 50 Rockwell Scale C or polycrystalline diamonds, wherein the rigid scraping portion includes a plurality of downwardly extending projections that are spaced apart from each other along the lateral axis, and wherein each of the projections extends along an axis parallel to an axis of an adjacent projection and extends at an acute angle with respect to the lateral axis.

14. The scraper of claim 13, wherein each of the plurality of downwardly extending projections includes a pointed attack edge.

15. The scraper of claim 14, wherein the pointed attack edge is formed by a conical surface defining a cone angle.

16. The scraper of claim 15, wherein the cone angle ranges from 100.0 degrees to 160.0 degrees.

17. The scraper of claim 13, wherein the plurality of downwardly extending projections form a pattern configured to remove the plurality of striations left during the milling process.

18. The scraper of claim 13, wherein the milling machine is moveable in a direction of travel and the plurality of projections are arranged in a plane normal to the direction of travel such that the acute angle is within the plane.

* * * * *